US009748624B2

(12) United States Patent
Wada

(10) Patent No.: US 9,748,624 B2
(45) **Date of Patent: *Aug. 29, 2017**

(54) NON-RECIPROCAL CIRCUIT ELEMENT

(71) Applicant: Murata Manufacturing Co., Ltd., Nagaokakyo-shi, Kyoto-fu (JP)

(72) Inventor: Takaya Wada, Nagaokakyo (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/447,776

(22) Filed: Jul. 31, 2014

(65) Prior Publication Data

US 2014/0340166 A1 Nov. 20, 2014

Related U.S. Application Data

(63) Continuation of application No. PCT/JP2012/078318, filed on Nov. 1, 2012.

(30) Foreign Application Priority Data

Feb. 6, 2012 (JP) ..... 2012-022858

(51) Int. Cl.
*H01P 1/36* (2006.01)
*H01P 1/365* (2006.01)

(52) U.S. Cl.
CPC ..... *H01P 1/365* (2013.01); *H01P 1/36* (2013.01)

(58) Field of Classification Search
CPC ..... H01P 1/32; H01P 1/38
(Continued)

(56) References Cited

U.S. PATENT DOCUMENTS 5,945,887 A * 8/1999 Makino ..... H01P 1/383 333/1.1
7,825,744 B2 * 11/2010 Kawanami ..... 333/24.2
(Continued)

FOREIGN PATENT DOCUMENTS

GB 1 247 933 A 9/1971
JP 49-13893 B1 4/1974
(Continued)

OTHER PUBLICATIONS

Official Communication issued in International Patent Application No. PCT/JP2012/078318, mailed on Feb. 5, 2013.

*Primary Examiner* — Stephen E Jones
(74) *Attorney, Agent, or Firm* — Keating & Bennett, LLP

(57) ABSTRACT

A non-reciprocal circuit element includes a ferrite, a first central electrode and a second central electrode that are arranged on the ferrite so as to cross each other in an insulated state, and a permanent magnet configured to apply a DC magnetic field to a portion where the first and second central electrodes cross each other. One end of the first central electrode defines an input port and the other end thereof defines an output port. One end of the second central electrode defines the input port and the other end thereof defines a ground port. A resistance element and a capacitance element which are connected in parallel with each other are connected in series between the input port and the output port. A switching capacitance unit configured to switch a capacitance is connected in parallel with the resistance element between the input port and the output port.

12 Claims, 11 Drawing Sheets

(58) Field of Classification Search
USPC ..... 333/1.1, 24.2
See application file for complete search history.

(56) References Cited

U.S. PATENT DOCUMENTS

| | | | | |
|---|---|---|---|---|
| 8,130,054 | B1 * | 3/2012 | Martin et al. | 333/24 R |
| 2006/0028286 | A1 | 2/2006 | Kishimoto et al. | |
| 2007/0030089 | A1 * | 2/2007 | Hino | H01P 1/36 333/1.1 |
| 2008/0218288 | A1 | 9/2008 | Hino | |
| 2008/0309426 | A1 | 12/2008 | Furuta et al. | |
| 2009/0058551 | A1 * | 3/2009 | Wada et al. | 333/24.2 |
| 2013/0147574 | A1 | 6/2013 | Wada | |
| 2014/0080431 | A1 | 3/2014 | Wada et al. | |

FOREIGN PATENT DOCUMENTS

| | | | |
|---|---|---|---|
| JP | 2006-050543 | A | 2/2006 |
| JP | 2007-208943 | A | 8/2007 |
| JP | 2008-085981 | A | 4/2008 |
| JP | 5418682 | B2 | 2/2014 |
| WO | 2008/087782 | A1 | 7/2008 |
| WO | 2012/020613 | A1 | 2/2012 |
| WO | 2012/172882 | A1 | 12/2012 |

* cited by examiner

NON-RECIPROCAL CIRCUIT ELEMENT

BACKGROUND OF THE INVENTION

1. Field of the Invention

The present invention relates to non-reciprocal circuit elements and more particularly to a non-reciprocal circuit element, such as an isolator or circulator, preferably for use in microwave bands.

2. Description of the Related Art

Hitherto, non-reciprocal circuit elements, such as isolators and circulators, have characteristics of transmitting signals only in a predetermined specific direction but not in the opposite direction. By making use of these characteristics, for example, isolators are used in transmission circuit sections of mobile communication devices, such as mobile phones.

As a non-reciprocal circuit element of this type, there is known a two-port isolator with low insertion loss as described in Japanese Unexamined Patent Application Publication No. 2007-208943. As illustrated in FIG. 14, in this isolator 100, a first central electrode 135 and a second central electrode 136 (inductors L11 and L12) are arranged on the surface of a ferrite 132 so as to cross each other in an insulated state. DC magnetic fields are applied by permanent magnets (not illustrated) to portions where the first and second central electrodes 135 and 136 cross each other, so that the first and second central electrodes 135 and 136 are magnetically coupled to each other. One end of the first central electrode 135 serves as an input port P1, whereas the other end thereof serves as an output port P2. One end of the second central electrode 136 serves as the output port P2, whereas the other end thereof serves as a ground port P3. A terminating resistor R11 and a capacitor C11, which are connected in parallel with each other, are connected between the input port P1 and the output port P2. Also, a capacitor C12 is connected in parallel with the second central electrode 136. The first central electrode 135 and the capacitor C11 form a resonant circuit, whereas the second central electrode 136 and the capacitor C12 form a resonant circuit. Further, impedance adjusting capacitors CS11 and CS12 are respectively connected to the input port P1 and the output port P2. The isolator 100 also includes external connection terminals IN, OUT, and GND.

The isolator 100 is built into a transmission circuit of mobile phones. Specifically, the input-side external connection terminal IN is connected to a transmission-side power amplifier PA via matching circuits 60 and 70. The output-side external connection terminal OUT is connected to an antenna via a duplexer or the like.

In general, the output impedance of the power amplifier PA is low, e.g., approximately 5Ω, whereas the input impedance of the isolator 100 is high, e.g., approximately 50Ω. The input impedance of the isolator 100 can be lowered by decreasing an angle at which the first and second central electrodes 135 and 136 cross each other and by including the capacitor CS11 as described in Japanese Unexamined Patent Application Publication No. 2007-208943. However, because of a desire to make the isolator 100 smaller, there is a limit as to how small the crossing angle (the input impedance) can be.

Accordingly, the matching circuit 60 including a capacitor C14 and an inductor L13 and the matching circuit 70 including a capacitor C15 and an inductor L14 are provided between the isolator 100 and the power amplifier PA so that the impedance is gradually increased to match the impedance of the isolator 100. However, providing the matching circuits 60 and 70 leads to an increase in insertion loss and an increase in the number of components or cost of a transmission circuit. As illustrated in FIG. 14, the insertion loss reaches 1.2 dB in total as a result of the insertion loss of the matching circuits 60 and 70, which is 0.7 dB, being added to the insertion loss of the isolator 100, which is 0.5 dB.

Also, as a non-reciprocal circuit element of this type, Japanese Unexamined Patent Application Publication No. 2008-85981 describes a non-reciprocal circuit element in which a first variable matching mechanism is connected in series with a plurality of matching capacitors so as to change reactance of the first variable matching mechanism in order to obtain sufficient isolation characteristics in a given frequency band.

However, this non-reciprocal circuit element has a drawback in that insertion loss becomes larger because a high-frequency current passes through the first variable matching mechanism when the high-frequency current is input from the forward direction.

SUMMARY OF THE INVENTION

Preferred embodiments of the present invention provide a non-reciprocal circuit element with which low input impedance is implemented, an increase in a number of components or cost of a transmission-side circuit is significantly reduced or prevented, and an isolation frequency is adjustable without worsening insertion loss.

A non-reciprocal circuit element according to a first preferred embodiment of the present invention includes a microwave magnetic material, a first central electrode and a second central electrode that are arranged on the microwave magnetic material so as to cross each other in an insulated state, and a permanent magnet configured to apply a DC magnetic field to a portion where the first and second central electrodes cross each other, wherein one end of the first central electrode defines an input port and the other end of the first central electrode defines an output port, one end of the second central electrode defines the input port and the other end of the second central electrode defines a ground port, a resistance element and a capacitance element which are connected in parallel with each other are connected in series between the input port and the output port, and a switching capacitance unit configured to switch capacitance is connected in parallel with the resistance element between the input port and the output port.

A non-reciprocal circuit element according to a second preferred embodiment of the present invention includes a microwave magnetic material, a first central electrode and a second central electrode that are arranged on the microwave magnetic material so as to cross each other in an insulated state, and a permanent magnet configured to apply a DC magnetic field to a portion where the first and second central electrodes cross each other, wherein one end of the first central electrode defines an input port and the other end of the first central electrode defines an output port, one end of the second central electrode defines the input port and the other end of the second central electrode defines a ground port, a resistance element and a capacitance element which are connected in parallel with each other are connected in series between the input port and the output port, and the capacitance element has a variable capacitance.

In the non-reciprocal circuit elements according to the first and second preferred embodiments of the present invention, inductance of the second central electrode preferably is set to be larger than an inductance of the first central electrode. With this configuration, in response to input of a high-frequency signal from the input port (forward-direction input), potentials at both ends of the first central electrode become equal due to a gyrator operation and current hardly flows through the first central electrode and the terminating resistor and is output to the output port. On the other hand, in response to input of a high-frequency signal from the output port (reverse-direction input), the high-frequency signal does not pass through the first central electrode because of the non-reciprocal property but flows through and is consumed as heat by the resistance element. That is, the current is attenuated (isolated). Relatively large inductance of the second central electrode lowers input impedance to one half or approximately one half of the input impedance of the related art, for example. Therefore, the matching circuits provided between the non-reciprocal circuit element and a power amplifier preferably are omitted or the number of matching circuits are decreased. As a result, insertion loss of a transmission-side circuit is decreased and the number of components and/or cost thereof is reduced.

Also, the isolation frequency for the reverse-direction input is adjusted by changing the capacitance value of the switching capacitance unit in the non-reciprocal circuit element according to the first preferred embodiment and by adjusting the capacitance value of the capacitance element in the non-reciprocal circuit element according to the second preferred embodiment. In addition, the amount of attenuation is adjusted by selecting the impedance of the resistance element. On the other hand, in response to input of a high-frequency signal from the forward direction, the high-frequency current hardly flows through the resistance element and the switching capacitance unit or capacitance element. Thus, even if the switching capacitance unit or the capacitance element is added, loss caused by the addition can be ignored and the insertion loss does not increase.

According to various preferred embodiments of the present invention, with a non-reciprocal circuit element, low input impedance is implemented, an increase in the number of components or cost of a transmission-side circuit is prevented or significantly reduced, and the isolation frequency is adjustable without worsening insertion loss.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
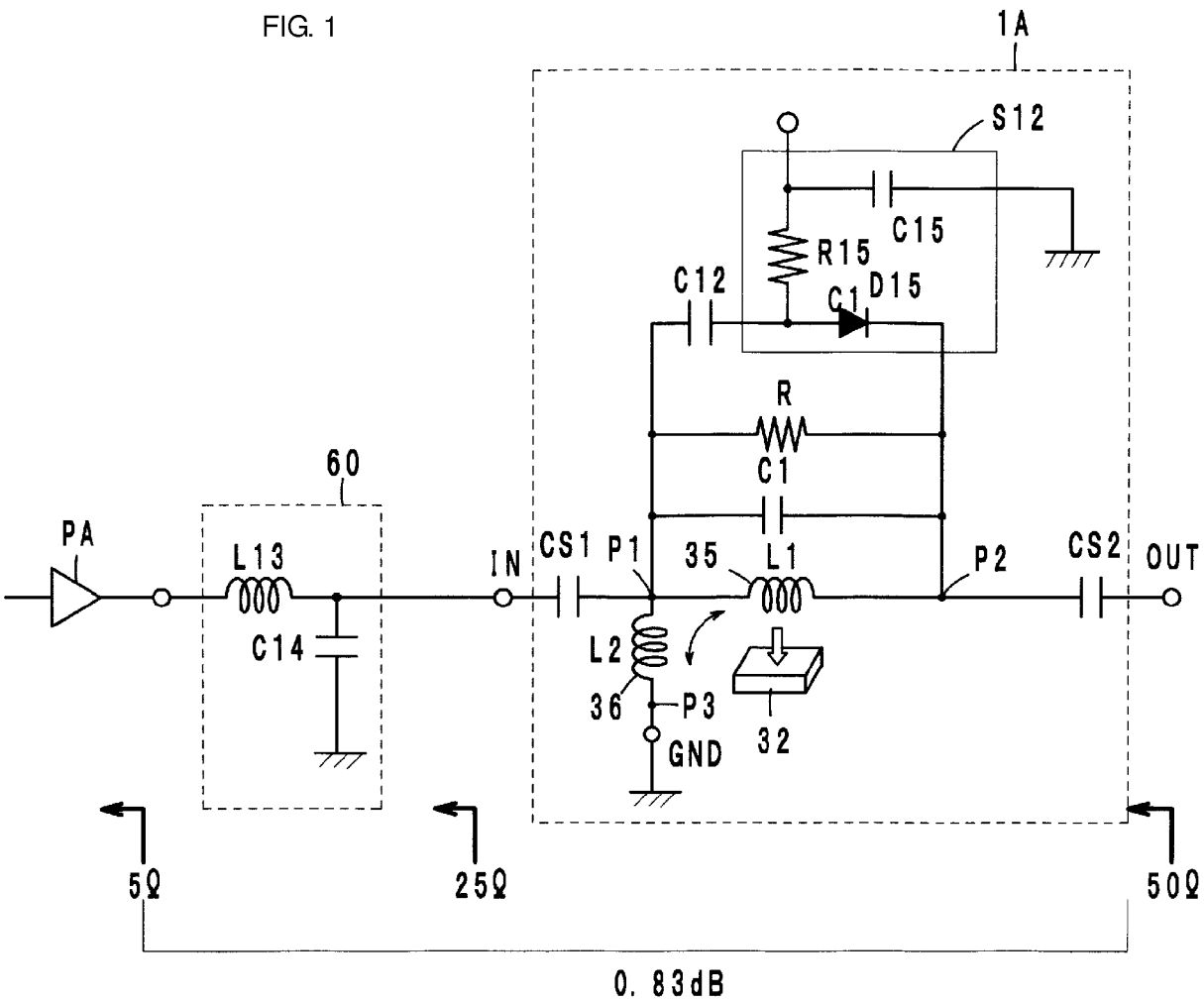
FIG. 1 is an equivalent circuit diagram of a transmission-side circuit including an isolator according to a first preferred embodiment of the present invention.

Preferred embodiments of a non-reciprocal circuit element according to the present invention will be described below with reference to the accompanying drawings. Note that similar components or portions are denoted by common reference numerals throughout the drawings and a repeated description will be omitted.

First Preferred Embodiment

As illustrated in an equivalent circuit of FIG. 1, a non-reciprocal circuit element (two-port lumped constant isolator 1A) according to a first preferred embodiment of the present invention preferably is configured in the following manner. A first central electrode 35 and a second central electrode 36 (inductors L1 and L2) are arranged on the surface of a microwave magnetic material (hereinafter, referred to as a ferrite 32) so as to cross each other in an insulated state. DC magnetic fields are applied to portions where the first and second central electrodes 35 and 36 cross each other by permanent magnets 41 (see FIGS. 2 and 3), so that the first and second central electrodes 35 and 36 are magnetically coupled to each other. One end of the first central electrode 35 defines and serves as an input port P1, whereas the other end thereof defines and serves as an output port P2. One end of the second central electrode 36 defines and serves as the input port P1, whereas the other end thereof serves as a ground port P3. A terminating resistor R and a capacitor C1, which are connected in parallel with each other, are connected between the input port P1 and the output port P2. Further, an adjusting capacitor C12 and a semiconductor switch S12, which are connected in series with each other, are connected in parallel with the terminating resistor R and the capacitor C1 between the input port P1 and the output port P2.

The semiconductor switch S12 preferably is an SPST switch and includes a diode D15, a resistor R15, and a capacitor C15, for example. Alternatively, an SPDT switch, MEMS switch, or the like may be used as the semiconductor switch S12.

The first central electrode 35, the capacitors C1 and C12, and the terminating resistor R define a resonant circuit. Further, impedance adjusting capacitors CS1 and CS2 are respectively connected to the input port P1 and the output port P2. The isolator 1A also includes external connection terminals IN, OUT, and GND.

The isolator 1A is preferably included in or built into a transmission circuit of mobile phones, for example. Specifically, the input-side external connection terminal IN preferably is connected to a transmission-side power amplifier PA via a matching circuit 60. The output-side external connection terminal OUT is connected to an antenna via a duplexer or the like.

Figure 14:
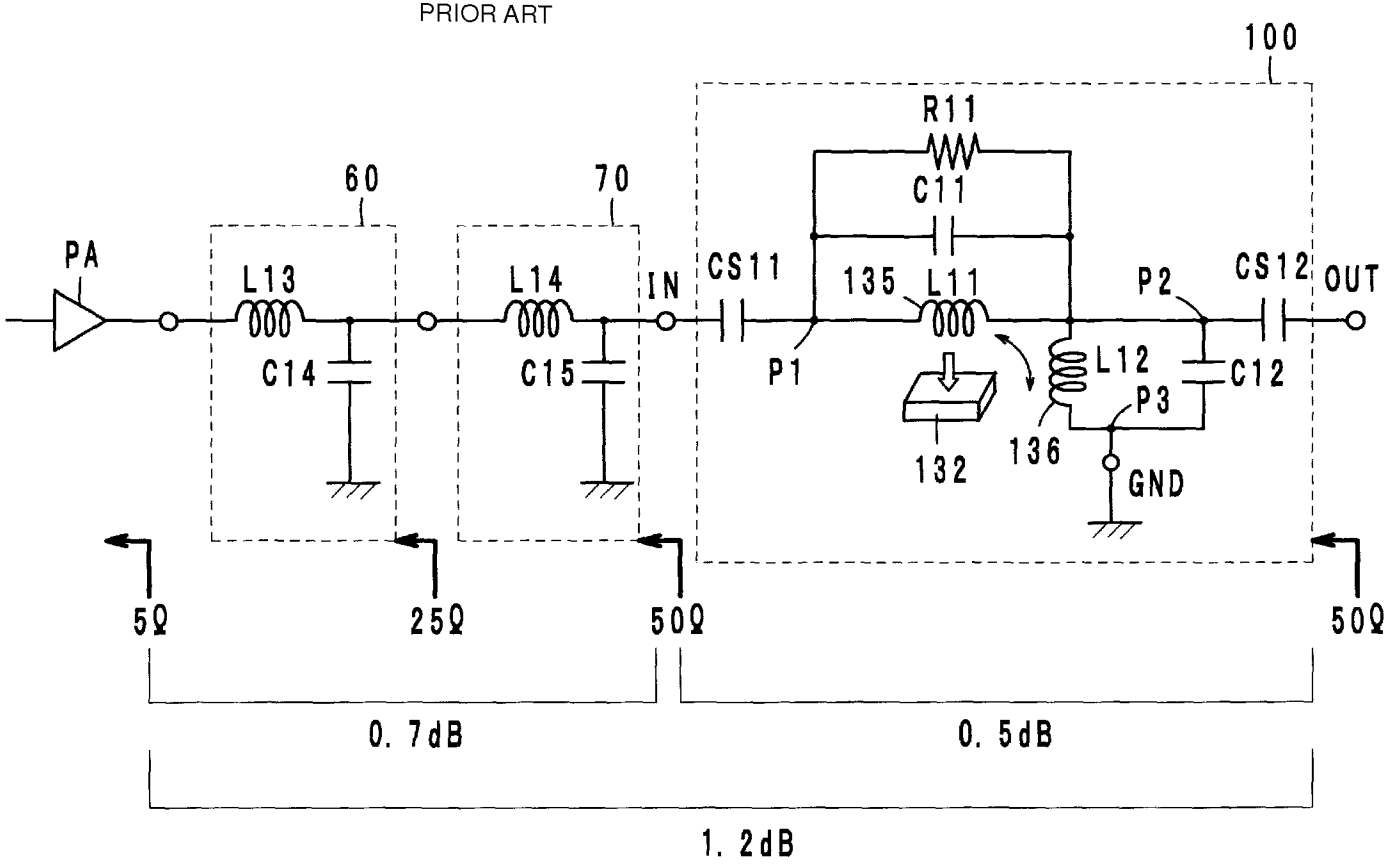
FIG. 14 PRIOR ART
FIG. 14 is an equivalent circuit diagram of a transmission-side circuit including an isolator according to the related art.

In the isolator 1A, inductance of the second central electrode 36 is set to be larger than inductance of the first central electrode 35. With this configuration, in response to input of a high-frequency signal from the input port P1, potentials at both ends of the first central electrode 35 become equal or substantially equal due to a gyrator operation and current hardly flows through the first central electrode 35 and the terminating resistor R and is output to the output port P2. On the other hand, in response to input of a high-frequency signal from the output port P2, the high-frequency signal does not pass through the first central electrode 35 because of the non-reciprocal property but flows through and is consumed as heat by the terminating resistor R. That is, the current is attenuated (isolated). Relatively large inductance of the second central electrode 36 lowers input impedance to one half or approximately one half of the original input impedance. Therefore, the matching circuits provided between the isolator 1A and the power amplifier PA preferably are omitted or the number of matching circuits is decreased. Specifically, the matching circuit 70 illustrated in FIG. 14 preferably is omitted. As a result, insertion loss of the transmission-side circuit is decreased and the number of components and/or cost thereof is reduced. Also, an angle at which the first and second central electrodes 35 and 36 cross each other need not be made extremely small in order to lower the input impedance.

The isolation frequency is adjusted by switching between ON and OFF of the adjusting capacitor C12 with the semiconductor switch S12. Also, an amount of attenuation is adjusted by selecting the impedance of the terminating resistor R. On the other hand, during an operation in which the high-frequency current flows from the input port P1 to the output port P2, the high-frequency current hardly flows through the terminating resistor R and the capacitors C1 and C12. Thus, even if the capacitor C12 and the switching element S12 are added, loss caused by the addition can be ignored and the insertion loss does not increase.

Figure 2:
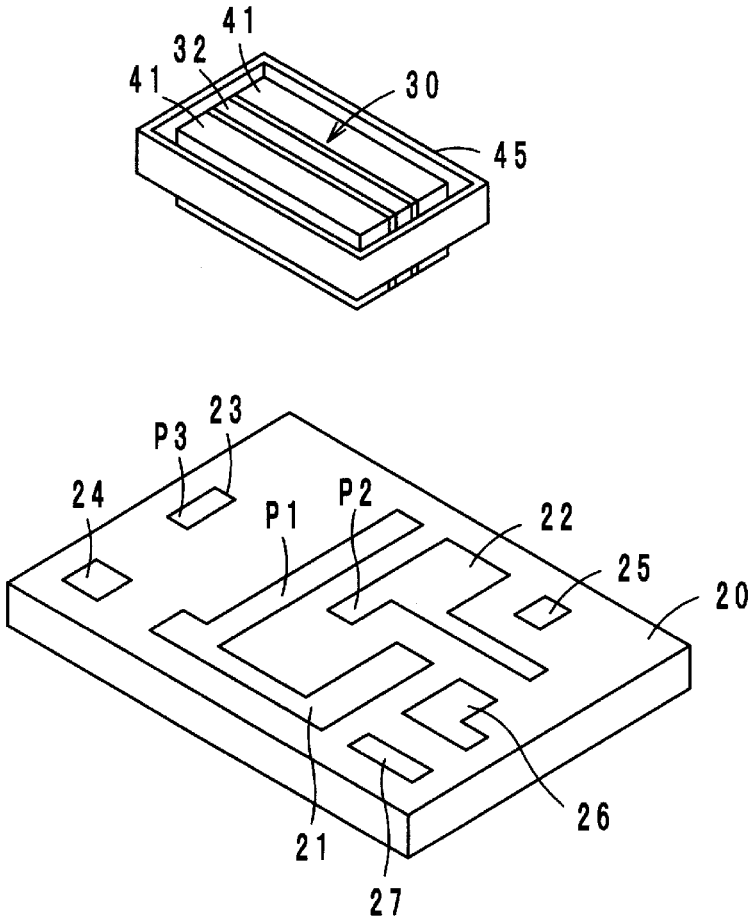
FIG. 2 is an exploded perspective view of the isolator according to the first preferred embodiment of the present invention.
Figure 3:
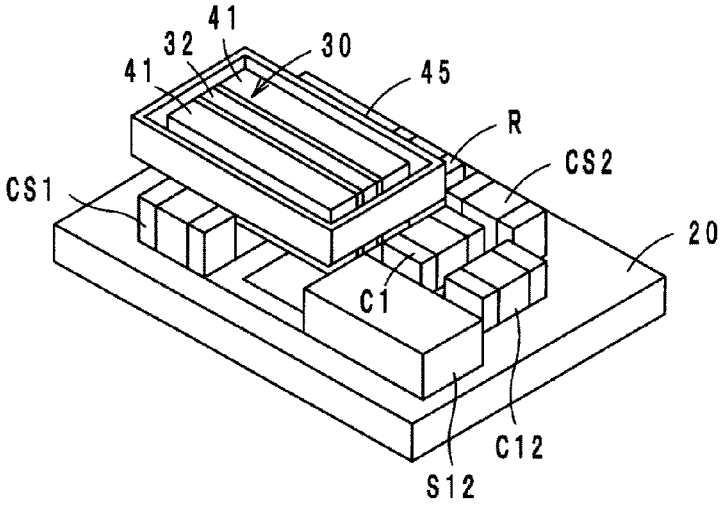
FIG. 3 is a perspective view of the isolator according to the first preferred embodiment of the present invention.
Figure 4:
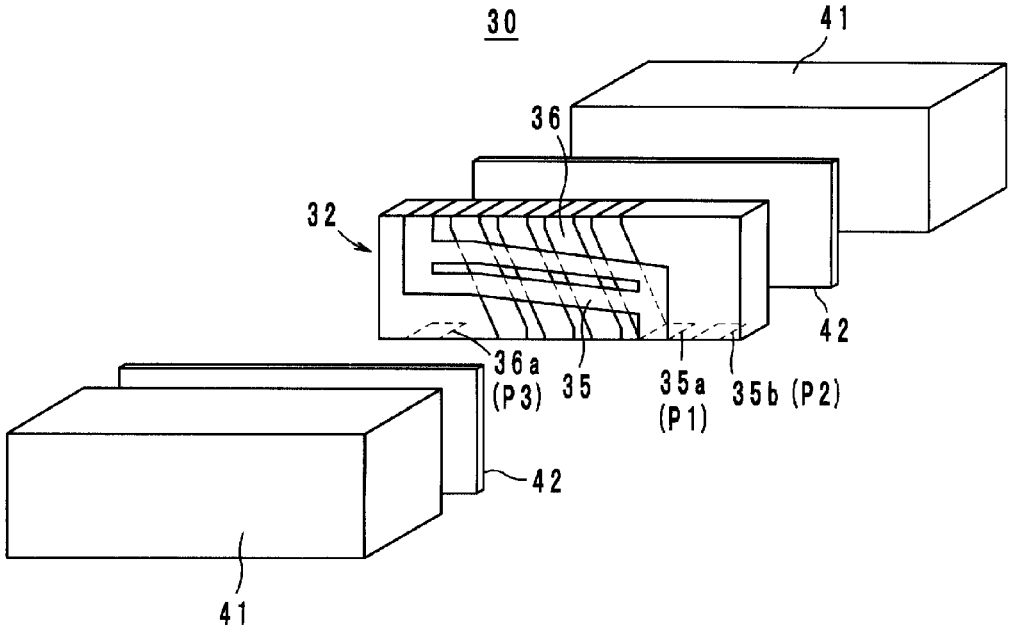
FIG. 4 is an exploded perspective view illustrating a ferrite-magnet element included in the isolator according to the first preferred embodiment of the present invention.

The configuration of the isolator 1A will be specifically described below. As illustrated in FIGS. 2 to 4, in the isolator 1A, a ferrite-magnet element 30 is mounted on a circuit board 20. In the ferrite-magnet element 30, the ferrite 32 is fixed by a pair of permanent magnets 41 from the right and left sides with an adhesive layer 42 interposed between the ferrite 32 and each of the permanent magnets 41. On the ferrite 32, the first and second central electrodes 35 and 36 (the first and second inductors L1 and L2) defined by conductive films are provided. The ferrite-magnet element 30 is surrounded by a yoke 45. Each of the capacitors C1, CS1, CS2, and C12 and the terminating resistor R which constitute a matching circuit or resonant circuit preferably is defined by a chip and is mounted on the circuit board 20 along with the semiconductor switch S12.

As illustrated in FIG. 4, the first central electrode 35 is wound around the ferrite 32 by one turn. An electrode 35*a*, i.e., one end, defines and serves as the input port P1, whereas an electrode 35*b*, i.e., the other end, defines and serves as the output port P2. The second central electrode 36 is wound around the ferrite 32 by four turns (note that the number of turns may be any given value) so as to cross the first central electrode 35 at a certain angle, for example. The electrode 35*a*, i.e., one end, (which is shared by the first central electrode 35) defines and serves as the input port P1, whereas an electrode 36*a*, i.e., the other end, defines and serves as the ground port P3. Note that, in order to avoid complexity, FIG. 4 omits illustration of the electrodes provided on the back surface of the ferrite 32.

The circuit board 20 is a resin board in which resin substrates and conductor foils are stacked. On the upper surface of the circuit board 20, terminal electrodes 21 to 27 are provided. These terminal electrodes 21 to 27 are connected, through via-hole conductors (not illustrated), to the external connection terminals IN, OUT, and GND (see FIG. 1) provided on the lower surface of the circuit board 20. The electrode 35*a* (input port P1) provided on the ferrite 32 is connected to the terminal electrode 21. The electrode 35*b* (output port P2) is connected to the terminal electrode 22. The electrode 36*a* (ground port P3) is connected to the terminal electrode 23. The capacitor C1 is connected between the terminal electrodes 21 and 22. The capacitor CS1 is connected between the terminal electrodes 21 and 24. The capacitor CS2 is connected between the terminal electrodes 22 and 25. Further, the terminating resistor R is connected between the terminal electrodes 21 and 22. The capacitor C12 is connected between the terminal electrodes 22 and 26. The semiconductor switch S12 is connected between the terminal electrodes 26 and 27. In this way, the equivalent circuit illustrated in FIG. 1 is provided.

Figure 5:
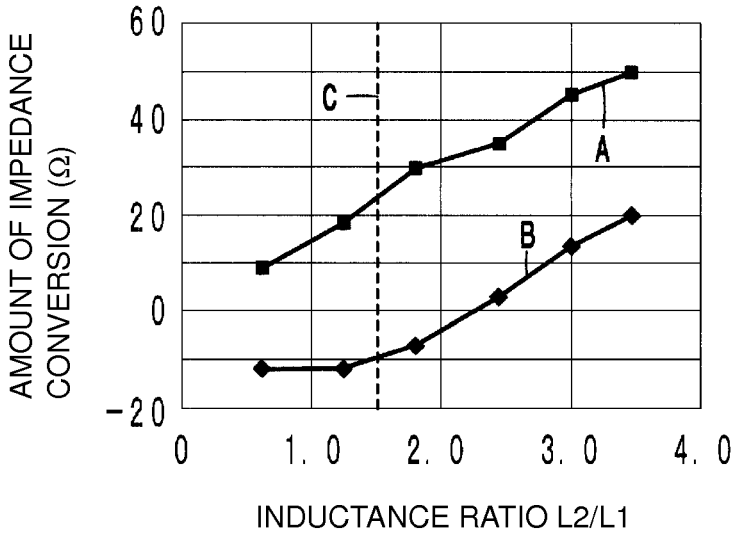
FIG. 5 is a graph illustrating an amount of impedance conversion provided by the isolator according to the first preferred embodiment of the present invention.

Now, an amount of impedance conversion provided between the ports P1 and P2 of the isolator 1A and an inductance ratio L2/L1 between inductances of the first and second central electrodes 35 and 36 will be described. Table 1 below and FIG. 5 illustrate a relationship between the inductance ratio L2/L1 and the amount of impedance conversion provided between the ports P1 and P2. The inductance ratio L2/L1 corresponds to a ratio between the numbers of turns of the first and second central electrodes 35 and 36. In FIG. 5, a characteristic curve A denotes the real part of impedance, whereas a characteristic curve B denotes the imaginary part of impedance. A point where a line C crosses the characteristic curve A for the real part denotes an amount of impedance conversion for the real part, which is 25Ω (input 25Ω, output 50Ω), illustrated in FIG. 1.

TABLE 1

| Ratio between | Ratio between | Input impedance (Ω) | | Output Impedance (Ω) | | Amount of impedance conversion (Ω) | |
|---|---|---|---|---|---|---|---|
| numbers of turns of L2/L1 | inductances of L2/L1 | Real part | Imaginary part | Real part | Imaginary part | Real part | Imaginary part |
| 1 | 0.6 | 1.9 | −9.7 | 11.0 | −22.0 | 9.1 | −12.3 |
| 2 | 1.2 | 9.0 | −23.0 | 27.0 | −35.0 | 18.0 | −12.0 |
| 3 | 1.8 | 20.0 | −38.0 | 50.0 | −45.0 | 30.0 | −7.0 |
| 4 | 2.4 | 35.0 | −48.0 | 70.0 | −45.0 | 35.0 | 3.0 |

TABLE 1-continued

| Ratio between | Ratio between | Input impedance (Ω) | | Output Impedance (Ω) | | Amount of impedance conversion (Ω) | |
|---|---|---|---|---|---|---|---|
| numbers of turns of L2/L1 | inductances of L2/L1 | Real part | Imaginary part | Real part | Imaginary part | Real part | Imaginary part |
| 5 | 3.0 | 50.0 | −58.0 | 95.0 | −45.0 | 45.0 | 13.0 |
| 6 | 3.4 | 70.0 | −65.0 | 120.0 | −45.0 | 50.0 | 20.0 |

Figure 6:
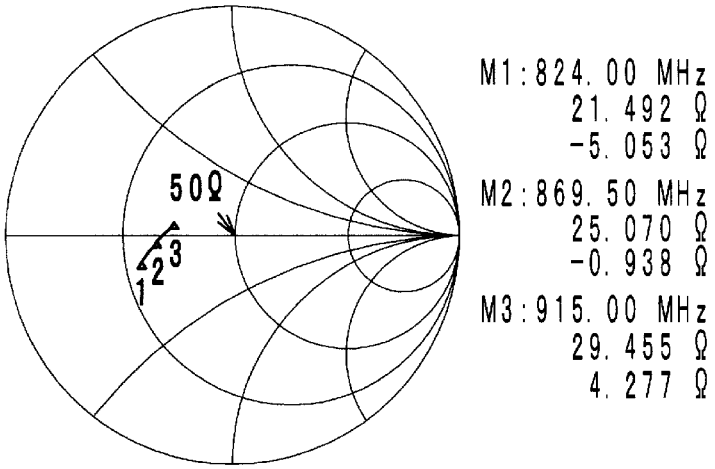
FIG. 6 is a Smith chart illustrating input matching characteristics of the isolator according to the first preferred embodiment of the present invention.
Figure 7:
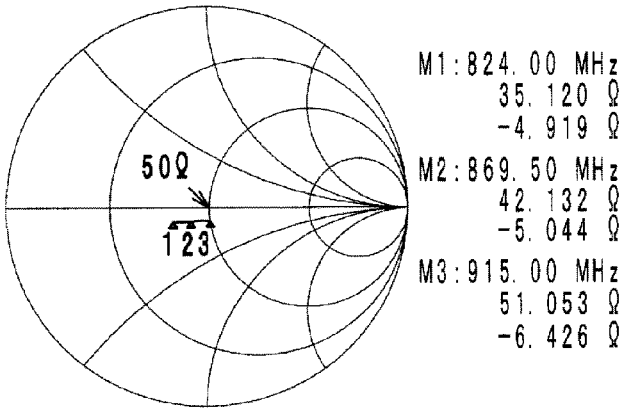
FIG. 7 is a Smith chart illustrating output matching characteristics of the isolator according to the first preferred embodiment of the present invention.
Figure 8:
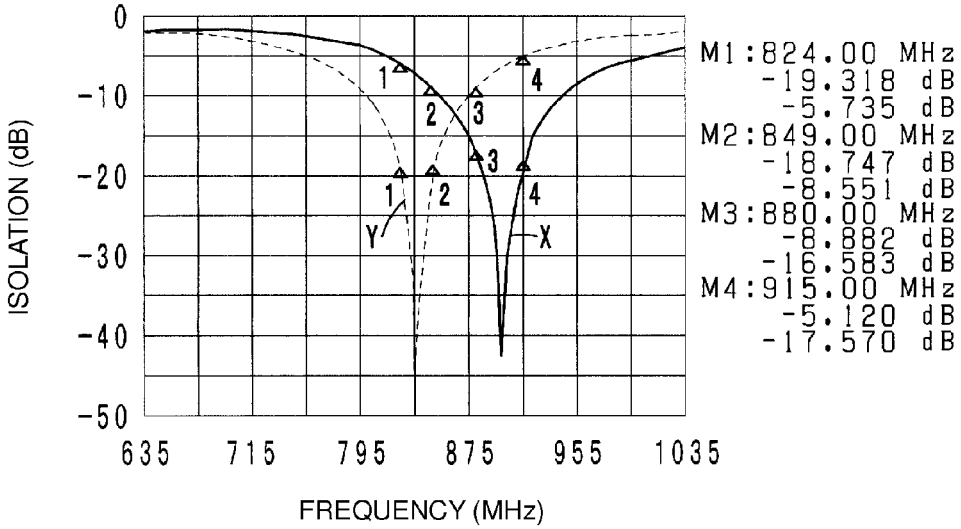
FIG. 8 is a graph illustrating isolation characteristics of the isolator according to the first preferred embodiment of the present invention.
Figure 9:
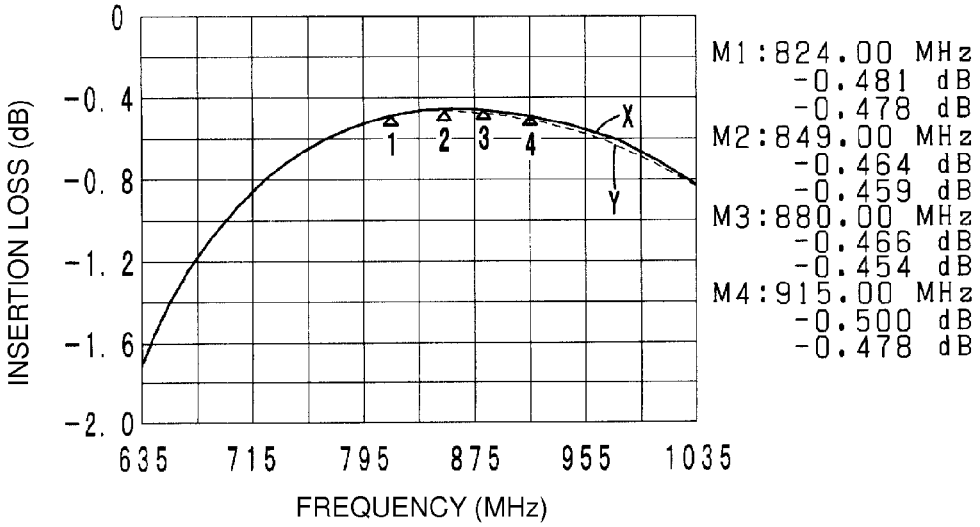
FIG. 9 is a graph illustrating insertion loss of the isolator according to the first preferred embodiment of the present invention.

Specifically, as the inductance ratio L2/L1 increases, the amounts of impedance conversion for the real and imaginary parts increase. By appropriately setting the numbers of turns of the first and second central electrodes 35 and 36, the amount of impedance conversion is adjusted. Impedance for the imaginary part is adjusted from a given value to 0Ω by the capacitors CS1 and CS2. Impedance conversion characteristics for 25-50Ω are as illustrated in the Smith chart of FIG. 6. Also, output impedance characteristics are as illustrated in the Smith chart of FIG. 7. FIG. 8 illustrates reverse-direction isolation characteristics. FIG. 9 illustrates forward-direction insertion loss characteristics. These electrical characteristics are for UMTS band 5 for Tx of 824-849 MHz and band 8 for TX of 880-915 MHz, for example.

In FIGS. 8 and 9, a curve X denotes characteristics in the case where the adjusting capacitor C12 is in an OFF state and the capacitor C1 alone is operating, and a curve Y denotes characteristics in the case where the capacitor C12 is in an ON state and is operating along with the capacitor C1 (the capacitors C1 and C12 are operating as balancing capacitors). As is apparent from FIG. 8, the isolation frequency is shifted toward a lower frequency band as a result of turning the adjusting capacitor C12 on. Specifically, the isolation characteristics which are at band 8 (880-915 MHz) when the capacitor C12 is in the OFF state shift to band 5 (824-849 MHz) when the capacitor C12 is turned ON. On the other hand, as is apparent from FIG. 9, characteristic curves X and Y respectively corresponding to the cases where the adjusting capacitor C12 is in the OFF state and the ON state almost coincide with each other, and the insertion loss does not worsen owing to insertion of the capacitor C12.

As illustrated in FIGS. 6 to 9, the isolator 1A according to the first preferred embodiment is configured to convert the impedance from about 25Ω to about 50Ω and has a significantly low insertion loss of about 0.5 dB, for example. Thus, as illustrated in FIG. 1, only one matching circuit 60 may be provided for the power amplifier PA whose output impedance is about 5Ω, for example In other words, the matching circuit 70 illustrated in FIG. 14 preferably is omitted. As a result, the total insertion loss is reduced to about 0.83 dB, for example.

Second Preferred Embodiment

Figure 10:
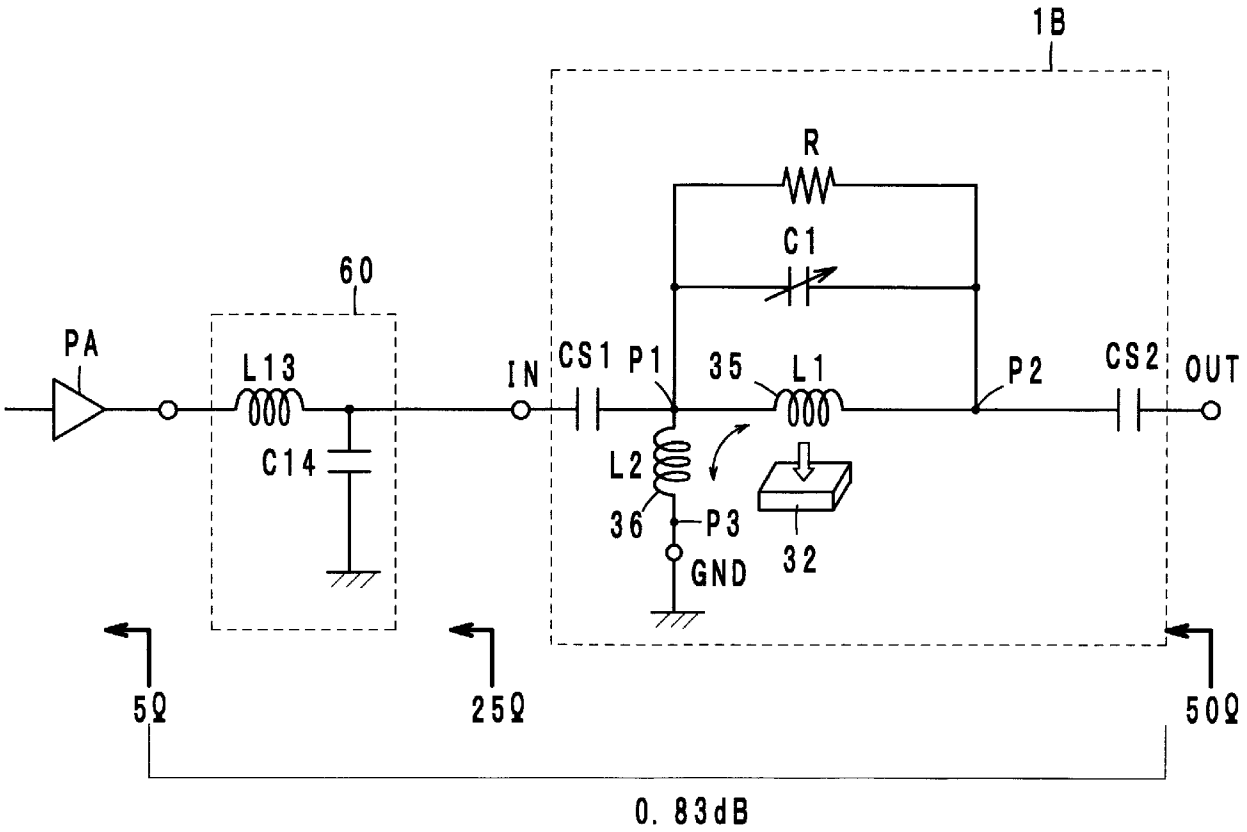
FIG. 10 is an equivalent circuit diagram of a transmission-side circuit including an isolator according to a second preferred embodiment of the present invention.

As illustrated in an equivalent circuit of FIG. 10, a non-reciprocal circuit element (two-port lumped constant isolator 1B) according to a second preferred embodiment of the present invention is configured such that a variable-capacitance capacitor is used as the capacitor C1. The variable-capacitance capacitor C1 may be capable of changing its capacitance value in a stepwise or continuous manner, for example.

In the second preferred embodiment, the variable-capacitance capacitor C1 is provided in place of the adjusting capacitor C12 and the semiconductor switch S12 of the first preferred embodiment. The other configuration of the second preferred embodiment preferably is the same as that of the first preferred embodiment, and advantageous effects thereof are basically the same as those of the first preferred embodiment.

Third Preferred Embodiment

Figure 11:
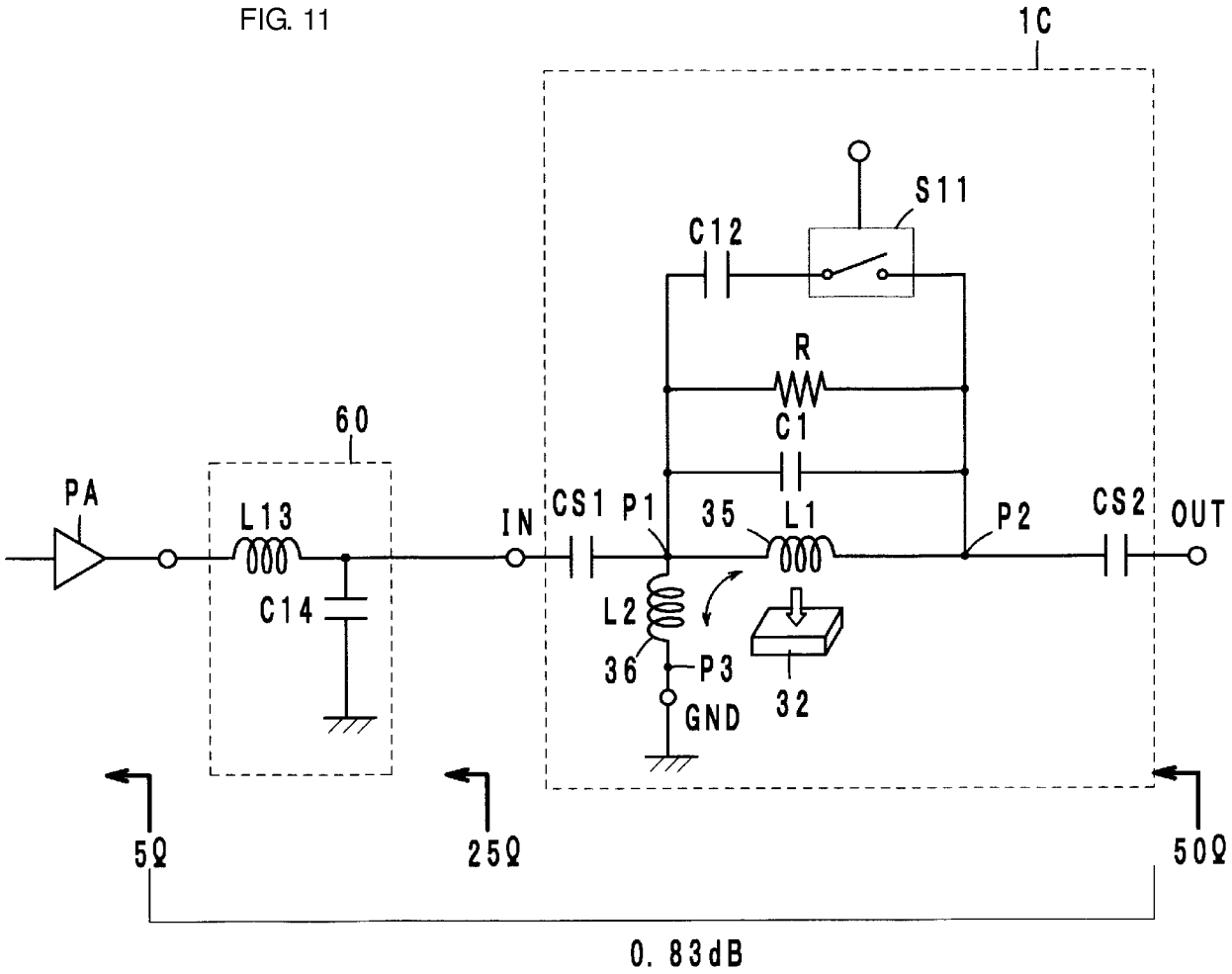
FIG. 11 is an equivalent circuit diagram of a transmission-side circuit including an isolator according to a third preferred embodiment of the present invention.

As illustrated in an equivalent circuit of FIG. 11, a non-reciprocal circuit element (two-port lumped constant isolator 1C) according to a third preferred embodiment is configured such that the semiconductor switch S12 of the first preferred embodiment is replaced with a mechanical switching element S11. The other configuration of the third preferred embodiment is preferably the same as that of the first preferred embodiment, and advantageous effects thereof are basically the same as those of the first preferred embodiment.

Fourth Preferred Embodiment

Figure 12:
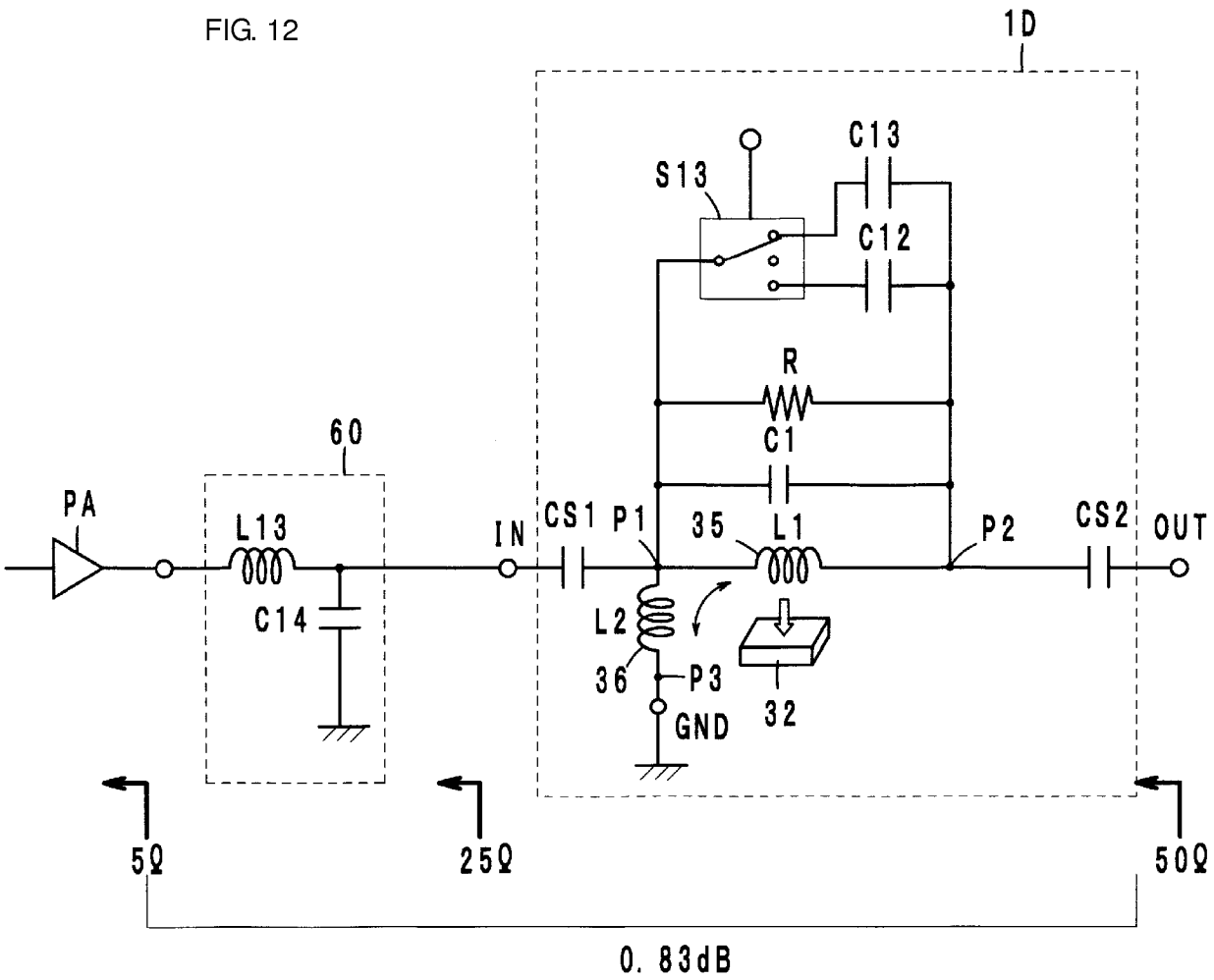
FIG. 12 is an equivalent circuit diagram of a transmission-side circuit including an isolator according to a fourth preferred embodiment of the present invention.

As illustrated in an equivalent circuit of FIG. 12, a non-reciprocal circuit element (two-port lumped constant isolator 1D) according to a fourth preferred embodiment is configured such that another adjusting capacitor C13 is additionally included along with the adjusting capacitor C12 and a switching element S13 to selectively switch between ON and OFF of the two adjusting capacitors C12 and C13 is connected. The switching element S13 is configured to separately switch between ON and OFF of the capacitors C12 and C13 and of selecting a neutral position. As the switching element, an SPDT switch or MEMS switch preferably is used, for example. In the fourth preferred embodiment, the adjustment capacitance value is preferably configured to be switched between three levels; however, the adjustment capacitance value may be switched between more than three levels, for example.

The other configuration of the fourth preferred embodiment is preferably the same as that of the first preferred embodiment, and advantageous effects thereof are basically the same as those of the first preferred embodiment.

Fifth Preferred Embodiment

Figure 13:
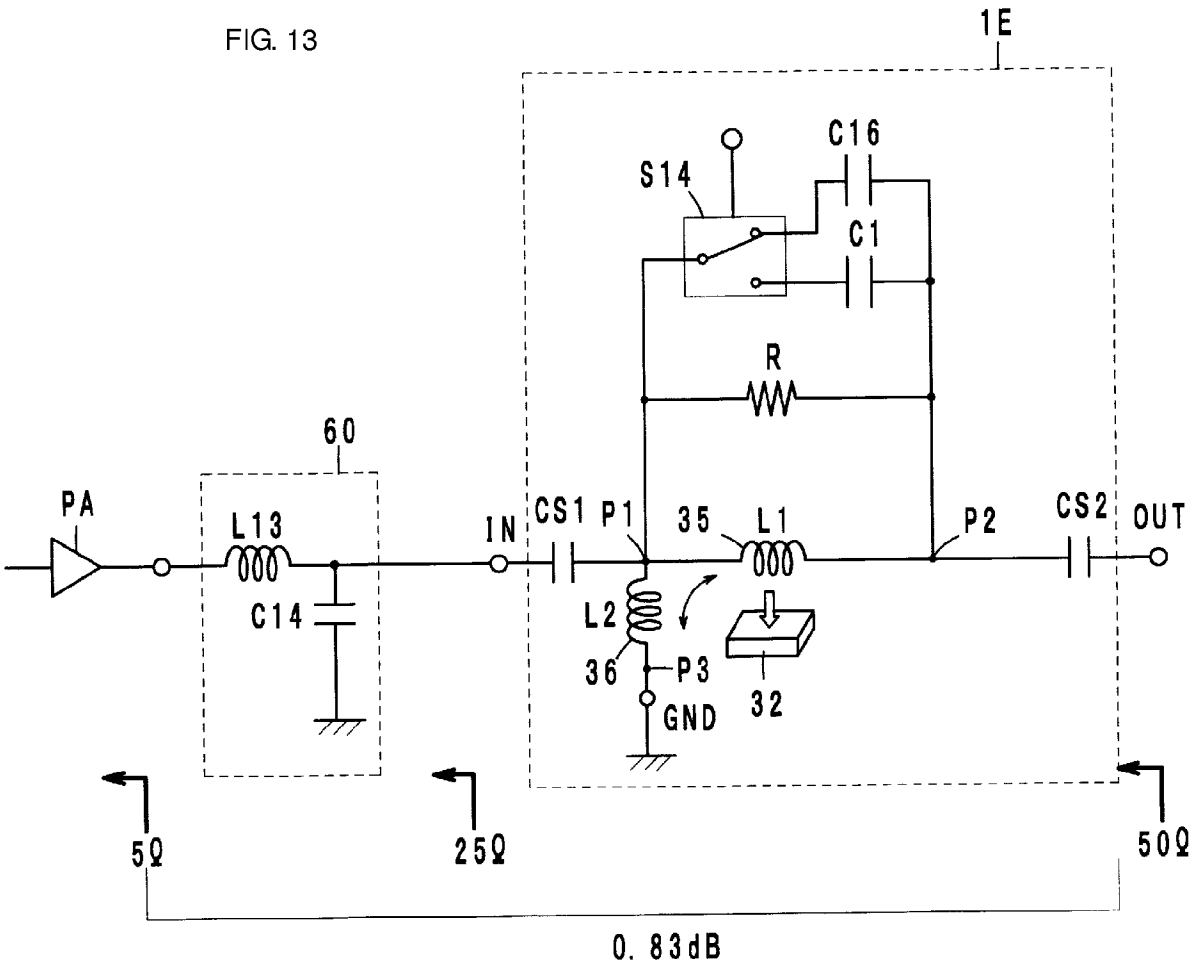
FIG. 13 is an equivalent circuit diagram of a transmission-side circuit including an isolator according to a fifth preferred embodiment of the present invention.

As illustrated in an equivalent circuit of FIG. 13, a non-reciprocal circuit element (two-port lumped constant isolator 1E) according to a fifth preferred embodiment of the present invention is configured such that a switching element S14 switches between ON and OFF of capacitors C1 and C16. The capacitor C1 illustrated in FIG. 13 is equivalent to the capacitor C1 described in the first preferred embodiment, and the capacitor C16 includes a capacitance equivalent to a total capacitance of the capacitors C1 and C12 connected in parallel with each other.

The other configuration of the fifth preferred embodiment preferably is the same as that of the first preferred embodiment, and advantageous effects thereof are basically the same as those of the first preferred embodiment. Note that the number of capacitors that are switched by the switching element S14 may be three or more, for example.

Other Preferred Embodiments

Note that the non-reciprocal circuit element according to the present invention is not limited to the above-described preferred embodiments and various alterations can be made within the scope of the gist thereof.

For example, the structure of the ferrite-magnet element 30 and the shapes of the first and second central electrodes 35 and 36 can be variously altered. Further, the capacitance elements and the resistance elements are not necessarily chip components externally mounted on the circuit board but may be built into a multi-layer circuit board, for example.

As described above, various preferred embodiments of the present invention are applicable in non-reciprocal circuit elements and are particularly excellent in that various preferred embodiments of the present invention are capable of implementing low input impedance, minimizing or preventing an increase in the number of components and/or cost of a transmission-side circuit, and adjusting the isolation frequency without worsening insertion loss.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A non-reciprocal circuit element comprising:
an input-side external connection terminal;
an output-side external connection terminal;
a microwave magnetic material;
a first central electrode and a second central electrode that are arranged on the microwave magnetic material so as to cross each other in an insulated state;
a permanent magnet configured to apply a DC magnetic field to a portion where the first and second central electrodes cross each other; and
a variable capacitance unit that has a variable capacitance; wherein
one end of the first central electrode defines an input port and the other end of the first central electrode defines an output port;
one end of the second central electrode defines the input port and the other end of the second central electrode defines a ground port;
only the second central electrode is disposed between the input port and the ground port;
a resistance element and a capacitance element which are connected in parallel with each other are connected in series between the input port and the output port;
the variable capacitance unit is connected in parallel with the resistance element between the input port and the output port; and
an inductance L2 of the second central electrode is larger than an inductance L1 of the first central electrode.

2. The non-reciprocal circuit element according to claim 1, wherein the variable capacitance unit includes at least two elements configured to be switched ON and OFF by a switching element.

3. The non-reciprocal circuit element according to claim 1, wherein the non-reciprocal circuit element is a two-port lumped constant isolator.

4. The non-reciprocal circuit element according to claim 1, wherein
the variable capacitance unit includes another capacitance element; and
the first central electrode, the capacitance element, and the another capacitance element define a resonant circuit.

5. The non-reciprocal circuit element according to claim 1, wherein
an inductance ratio L2/L1 is less than 3.0; and
a real part of an input impedance of the non-reciprocal circuit element is less than 50Ω.

6. The non-reciprocal circuit element according to claim 1, wherein the variable capacitance unit is a capacitance-variable capacitor.

7. The non-reciprocal circuit element according to claim 6, wherein the variable capacitance unit changes its capacitance in one of a stepwise manner or a continuous manner.

8. The non-reciprocal circuit element according to claim 6, wherein
an inductance ratio L2/L1 is about 0.6 or more.

9. The non-reciprocal circuit element according to claim 6, wherein an inductance ratio L2/L1 is about 1.8 or more.

10. A transmission circuit comprising:
a non-reciprocal circuit element;
a power amplifier connected with the non-reciprocal circuit element; and
a matching circuit;
the non-reciprocal circuit element comprising:
an input-side external connection terminal;
an output-side external connection terminal;
a microwave magnetic material;
a first central electrode and a second central electrode that are arranged on the microwave magnetic material so as to cross each other in an insulated state;
a permanent magnet configured to apply a DC magnetic field to a portion where the first and second central electrodes cross each other; and
a variable capacitance unit that has a variable capacitance; wherein
one end of the first central electrode defines an input port and the other end of the first central electrode defines an output port;
one end of the second central electrode defines the input port and the other end of the second central electrode defines a ground port;
only the second central electrode is disposed between the input port and the ground port;
a resistance element and a capacitance element which are connected in parallel with each other are connected in series between the input port and the output port;
the variable capacitance unit is connected in parallel with the resistance element between the input port and the output port; and
an inductance L2 of the second central electrode is larger than an inductance L1 of the first central electrode.

11. The transmission circuit according to claim 10, wherein the non-reciprocal circuit element is a two-port lumped constant isolator.

12. The transmission circuit according to claim 10, wherein the input-side external connection terminal is connected to the power amplifier directly or indirectly via the matching circuit.

* * * * *